US010595656B1

(12) United States Patent
Medina

(10) Patent No.: US 10,595,656 B1
(45) Date of Patent: Mar. 24, 2020

(54) CARPET-STRETCHING APPARATUS

(71) Applicant: Oscar Medina, Albuquerque, NM (US)

(72) Inventor: Oscar Medina, Albuquerque, NM (US)

( * ) Notice: Subject to any disclaimer, the term of this patent is extended or adjusted under 35 U.S.C. 154(b) by 0 days.

(21) Appl. No.: 16/408,943

(22) Filed: May 10, 2019

(51) Int. Cl.
*A47G 27/04* (2006.01)

(52) U.S. Cl.
CPC ..... *A47G 27/0493* (2013.01)

(58) Field of Classification Search
CPC ..... A47G 27/0493
See application file for complete search history.

(56) References Cited

U.S. PATENT DOCUMENTS 3,178,155 A * 4/1965 Bird ..... A47G 27/0493 254/212
3,752,440 A * 8/1973 Ream ..... A47G 27/0493 254/209
3,977,651 A * 8/1976 Chamberlain ..... A47G 27/0493 254/201
5,288,057 A * 2/1994 Listau ..... A47G 27/0493 254/212
5,472,170 A * 12/1995 Anasson ..... A47G 27/0493 254/201
5,782,458 A * 7/1998 Prinzi ..... A47G 27/0493 254/209
5,938,182 A * 8/1999 Goodrich ..... A47G 27/0493 254/200
6,491,284 B1 * 12/2002 Jolly ..... A47G 27/0493 254/209
6,669,174 B1 * 12/2003 Vita ..... A47G 27/0493 254/212
6,994,323 B2 * 2/2006 Carbajal ..... A47G 27/0493 254/200
2006/0060830 A1 * 3/2006 Behr ..... A47G 27/0493 254/209
2011/0068310 A1 * 3/2011 Despins ..... A47G 27/0493 254/211

* cited by examiner

*Primary Examiner* — Michael E Gallion
(74) *Attorney, Agent, or Firm* — The Iwashko Law Firm, PLLC; Lev Ivan Gabriel Iwashko

(57) ABSTRACT

A carpet-stretching apparatus, including a main frame to connect to at least a portion of a carpet as disposed on a surface, at least one carpet spike disposed on at least a portion of the main frame to be inserted into at least a portion of the carpet, such that at least a portion of the carpet moves in response to movement of at least a portion of the main frame, and a stretch bar manipulation assembly disposed on at least a portion of the main frame to move at least a portion of the main frame in response to a manipulation of the stretch bar manipulation assembly.

4 Claims, 4 Drawing Sheets

CARPET-STRETCHING APPARATUS

BACKGROUND

1. Field

The present general inventive concept relates generally to an apparatus, and particularly, to a carpet-stretching apparatus.

2. Description of the Related Art

Traditional carpet stretchers require a knee of a user to elongate the carpet by using the knee to strike a portion of the carpet stretcher. Specifically, a carpet stretcher has a carpet spike attached on a portion thereof, such that the carpet spike is placed on the carpet to move the carpet when the user applies a force to the carpet stretcher using the knee.

With this method, the user using the carpet stretcher must use a great deal of leg strength to stretch the carpet, which can lead to knee and/or leg injuries.

Therefore, there is a need for other types of carpet stretchers that do not require using the knee.

SUMMARY

The present general inventive concept provides a carpet-stretching apparatus.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a carpet-stretching apparatus, including a main frame to connect to at least a portion of a carpet as disposed on a surface, at least one carpet spike disposed on at least a portion of the main frame to be inserted into at least a portion of the carpet, such that at least a portion of the carpet moves in response to movement of at least a portion of the main frame, and a stretch bar manipulation assembly disposed on at least a portion of the main frame to move at least a portion of the main frame in response to a manipulation of the stretch bar manipulation assembly.

The main frame may include a first section, including a first side, a second side disposed perpendicularly away from a first end of the first side at a first end of the second side with respect to a first lateral direction, and a third side disposed perpendicularly away from a second end of the second side at a first end of the third side with respect to a second lateral direction, such that the third side is substantially parallel to the first side, and a second section pivotally disposed along at least a portion of a length of the second side to prevent movement of the first section in response to being disposed on the surface.

The first section may further include a stretch bar transversely disposed between at least a portion of the first side and at least a portion of the third side to move the at least one carpet spike in response to movement of the stretch bar, and a plurality of stretch-bar-receiving grooves disposed within at least a portion of the first side, and at least a portion of the third side to facilitate movement of the stretch bar therein.

The stretch bar manipulation assembly may include a handle to facilitate gripping thereof, and a release bar to facilitate movement of at least a portion of the main frame in response to movement of the release bar.

The carpet-stretching apparatus may further include a support bar disposed within a portion of the stretch bar manipulation assembly to prevent movement of the main frame in response to a force applied thereupon directed toward the surface.

The carpet-stretching apparatus may further include a mechanical cylinder disposed within at least a portion of the main frame to move at least a portion of the main frame in response to the manipulation of the stretch bar manipulation assembly.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1A:
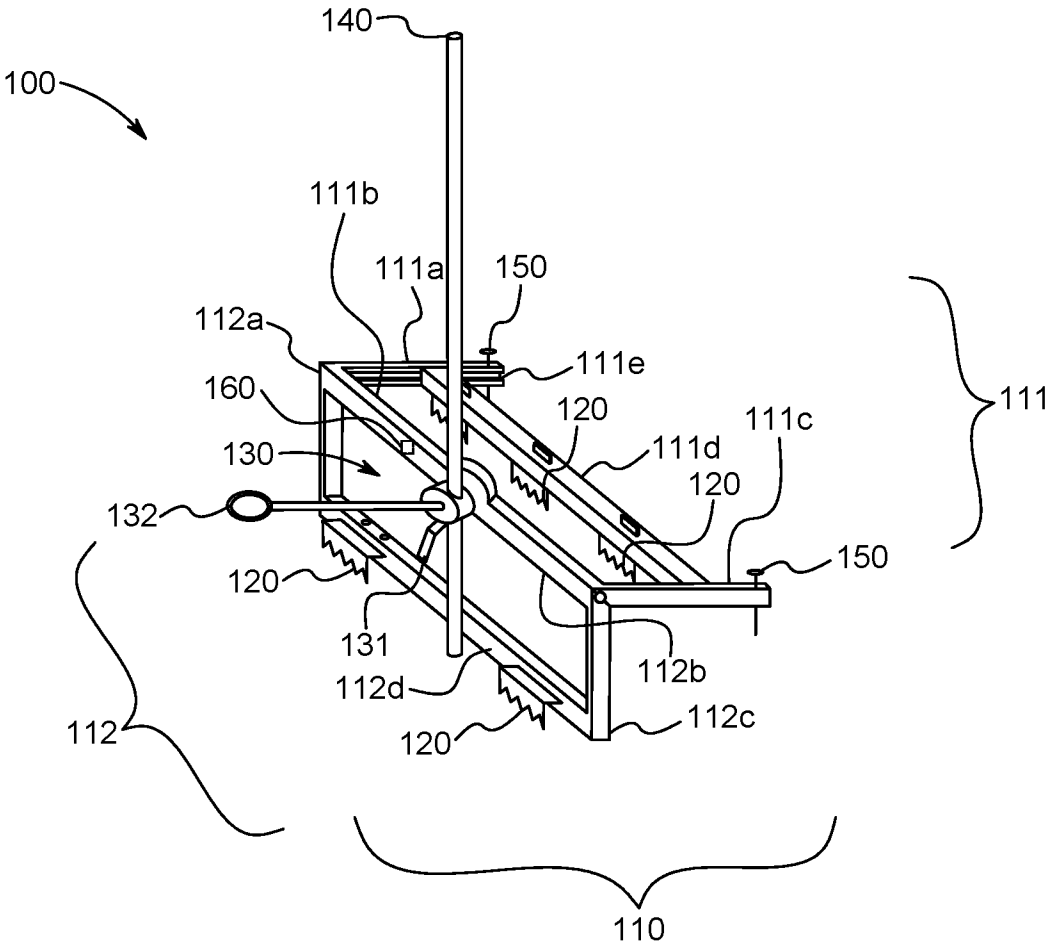
FIG. 1A illustrates a top isometric view of a carpet-stretching apparatus, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Carpet-Stretching Apparatus 100
Main Frame 110
First Section 111
First Side 111*a*
Second Side 111*b*
Third Side 111*c*
Stretch Bar 111*d*
Stretch-Bar-Receiving Groove 111*e*
Second Section 112
First Side 112*a*
Second Side 112*b*
Third Side 112*c*
Fourth Side 112*d*
Carpet Spike 120
Stretch Bar Manipulation Assembly 130
Handle 131
Release Bar 132
Support Bar 140
Fastener 150
Mechanical Cylinder 160

FIG. 1A illustrates a top isometric view of a carpet-stretching apparatus 100, according to an exemplary embodiment of the present general inventive concept.

The carpet-stretching apparatus 100 may be constructed from at least one of metal, plastic, wood, and rubber, etc., but is not limited thereto.

The carpet-stretching apparatus 100 may include a main frame 110, at least one carpet spike 120, a stretch bar manipulation assembly 130, a support bar 140, at least one fastener 150 and a mechanical cylinder 160, but is not limited thereto.

The main frame 110 may include a first section 111 and a second section 112, but is not limited thereto.

The main frame 110 may be disposed on a surface, such as a planar surface.

The first section 111 may include a first side 111*a*, a second side 111*b*, a third side 111*c*, a stretch bar 111*d*, and a plurality of stretch-bar-receiving grooves 111*e*, but is not limited thereto.

Each of the plurality of stretch-bar-receiving grooves 111*e* may include a spring therein.

The second section 112 may include a first side 112*a*, a second side 112*b*, a third side 112*c*, and a fourth side 112*d*, but is not limited thereto.

The second section 112 may be pivotally disposed on at least a portion of the first section 111. Specifically, the second side 112*b* of the second section 112 may be pivotally disposed along at least a portion of a length of the second side 111*b* of the first section 111. As such, the second section 112 may pivot from at least partially planar with respect to the first section 111 in a first position to at least partially angled with respect to the first section 111 in a second position. For example, the second section 112 may be substantially planar with respect to the first section 111 in the first position, and substantially perpendicular to the first section 111 in the second position.

Alternatively, the second section 112 may be removably disposed to the first section 111.

Figure 1B:
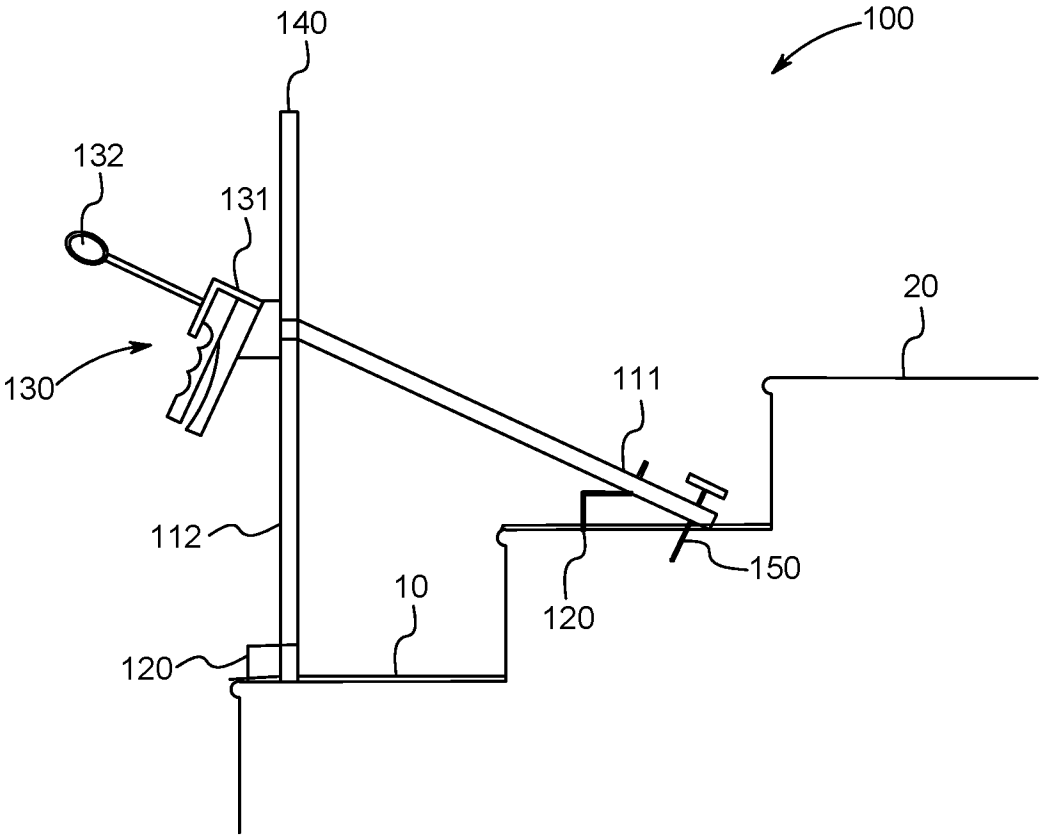
FIG. 1B illustrates a side view of the carpet-stretching apparatus as disposed on a staircase, according to an exemplary embodiment of the present general inventive concept.

FIG. 1B illustrates a side view of the carpet-stretching apparatus 100 as disposed on a staircase 20, according to an exemplary embodiment of the present general inventive concept.

Referring to FIGS. 1A and 1B, a user may dispose the main frame 110 on the staircase 20 to stretch a carpet 10 thereupon. Specifically, the first side 111*a*, the second side 111*b*, and the third side 111*c* of the first section 111 may be at least partially aligned with a portion of at least one first stair of the staircase 20. For example, the first section 111 may be oriented to be at least partially aligned with each side of the at least one first stair of the staircase 20.

The stretch bar 111*d* may be transversely disposed between at least a portion of the first side 111*a* and at least a portion of the third side 111*c* within at least a portion of the plurality of stretch-bar-receiving grooves 111*e*. In other words, each of the plurality of stretch-bar-receiving grooves 111*e* may be disposed within at least a portion of the first side 111*a* and at least a portion of the third side 111*c*. As such, the stretch bar 111*d* is in parallel with the second side 111*b* and may also be considered the fourth side 111*d*.

Furthermore, the stretch bar 111*d* may move (i.e. slide) in a first direction or a second direction from at least partially near a first end (i.e. the second side 111*b*) in a first lateral position to at least partially near a second end in a second lateral position, such that the stretch bar 111*d* may move away from the second side 111*b* of the first section 111. Alternatively, the stretch bar 111*d* may move in the second direction or the first direction from at least partially near the second end in the second lateral position to at least partially near the first end in the first lateral position, such that the stretch bar 111*d* may move toward the second side 111*b* of the first section 111.

Referring to FIG. 2, the second section 112 may prevent movement of the first section 111 on the staircase 20. The first side 112*a* and the third side 112*c* of the second section 112 may be substantially vertical with respect to the carpet 10 and the staircase 20. The fourth side 112*d* may provide a base in contact with the carpet 10 and/or the staircase 20 to increase stability thereupon. Additionally, the fourth side 112*d* may be disposed on at least a portion of at least one second side stair of the staircase 20, such that the at least one second stair of the staircase 20 is at a lower elevation with respect to the at least one first stair of the staircase 20.

Referring to FIG. 1, the at least one carpet spike 120 is illustrated to be disposed on at least a portion of the stretch bar 111*d* of the first section 111 and the fourth side 112*d* of the second section 112. However, the at least one carpet spike 120 and/or another at least one carpet spike 120 may also be disposed on at least a portion of the first side 111*a*, the second side 111*b*, and/or the third side 111*c* of the first section 111, and/or at least a portion of the first side 112*a*, the second side 112*b*, and/or the third side 112*c* of the second section 112. Furthermore, the at least one carpet spike 120 may be removably disposed on at least a portion of the main frame 110, such that the at least one carpet spike 120 may be position based on a preference of the user.

The at least one carpet spike 120 as disposed on the stretch bar 111*d* may extend into at least a portion of the carpet 10, such that the carpet 10 may move in response to movement of the stretch bar 111*d*.

The stretch bar manipulation assembly 130 may include a handle 131 and a release bar 132, but is not limited thereto.

Referring again to FIGS. 1 and 2, the handle 131 is illustrated to be a handle. However, the handle 131 may include a button, a lever, a switch, and a crank, but is not limited thereto.

The support bar 140 may be disposed within at least a portion of the stretch bar manipulation assembly 130. The support bar 140 may increase stability of the second section 112 on a rough surface, such as a concrete staircase. Specifically, the user may grip the support bar 140 to apply a force against the concrete staircase to prevent movement of the main frame 110.

The at least one fastener 150 may include a screw, a nail, a bolt, a nut, a washer, a clamp, and/or a clasp, but is not limited thereto.

The at least one fastener 150 may be disposed within at least a portion of the main frame 110. Specifically, the at least one fastener 150 may be inserted through a portion of the main frame 110 to extend in the surface, such as the staircase 20. For example, the staircase 20 may be a wooden staircase. As such, the at least one fastener 150 may prevent the main frame 110 from moving upon the staircase 20.

The mechanical cylinder 160 may include a pneumatic cylinder and/or a hydraulic cylinder, but is not limited thereto. Also, the mechanical cylinder may include a piston therein.

The mechanical cylinder 160 may be disposed within at least a portion of the main frame 110. Moreover, the mechanical cylinder 160 may be connected to the stretch bar manipulation assembly 130 and the stretch bar 111*d*. The user may squeeze the handle 131 to compress a piston within the mechanical cylinder 160, such that the stretch bar 111*d* may move in response to the compression of the piston. Specifically, the stretch bar 111*d* may move toward the second end of the first section 111. As such, the at least one carpet spike 120 may move in response to movement of the stretch bar 111*d*, such that the carpet 10 may stretch.

Subsequently, the user may push and/or pull the release bar 132 to decompress the piston within the mechanical cylinder 160. As such, the stretch bar 111*d* may move toward the first end of the first section 111 in response to the spring within each of the plurality of stretch-bar-receiving grooves 111*e* pushing and/or pulling the stretch bar 111*d*. In other words, the stretch bar 111*d* may be reset and be used to stretch at least another portion of the carpet 10.

Figure 2A:
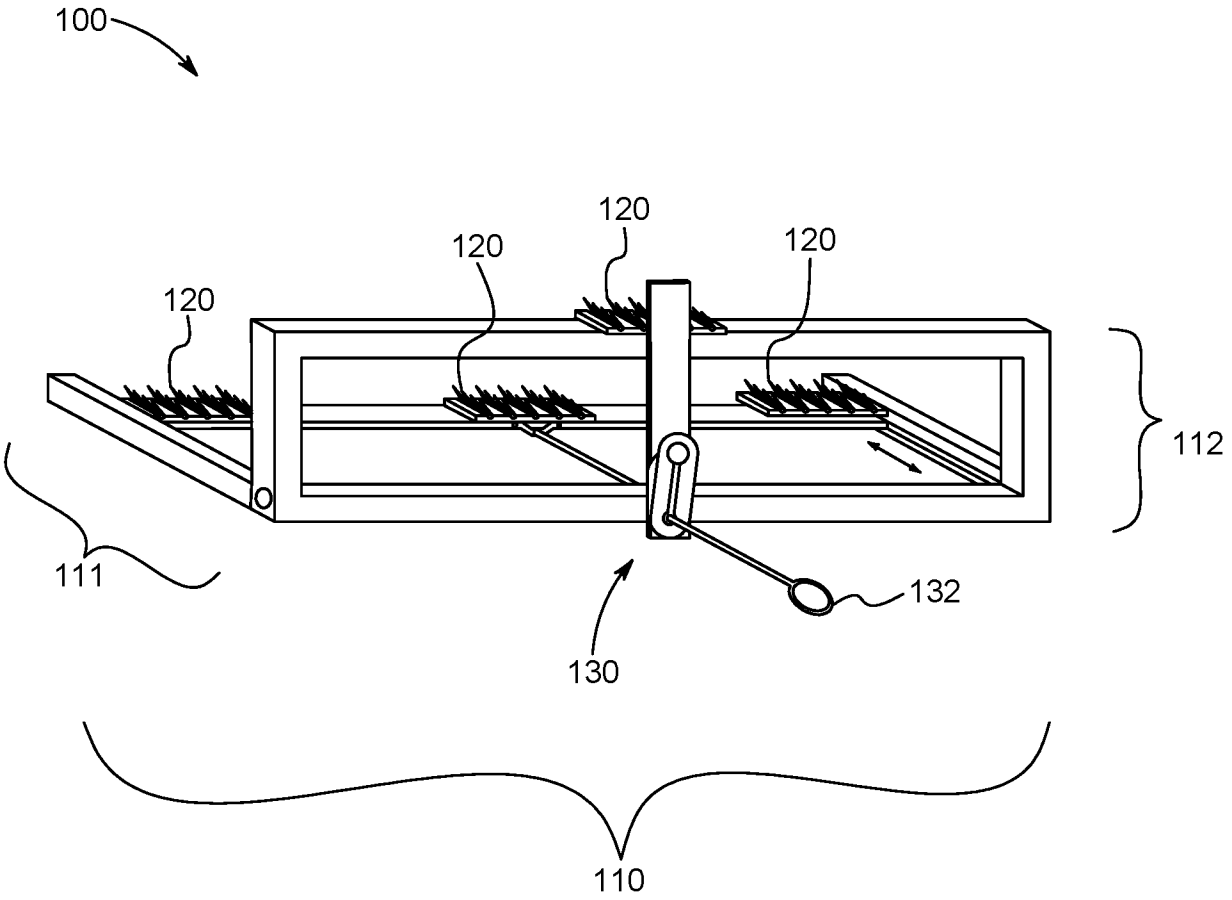
FIG. 2A illustrates a front perspective view of the carpet-stretching apparatus, according to an exemplary embodiment of the present general inventive concept.

FIG. 2A illustrates a front perspective view of the carpet-stretching apparatus 100, according to an exemplary embodiment of the present general inventive concept.

Figure 2B:
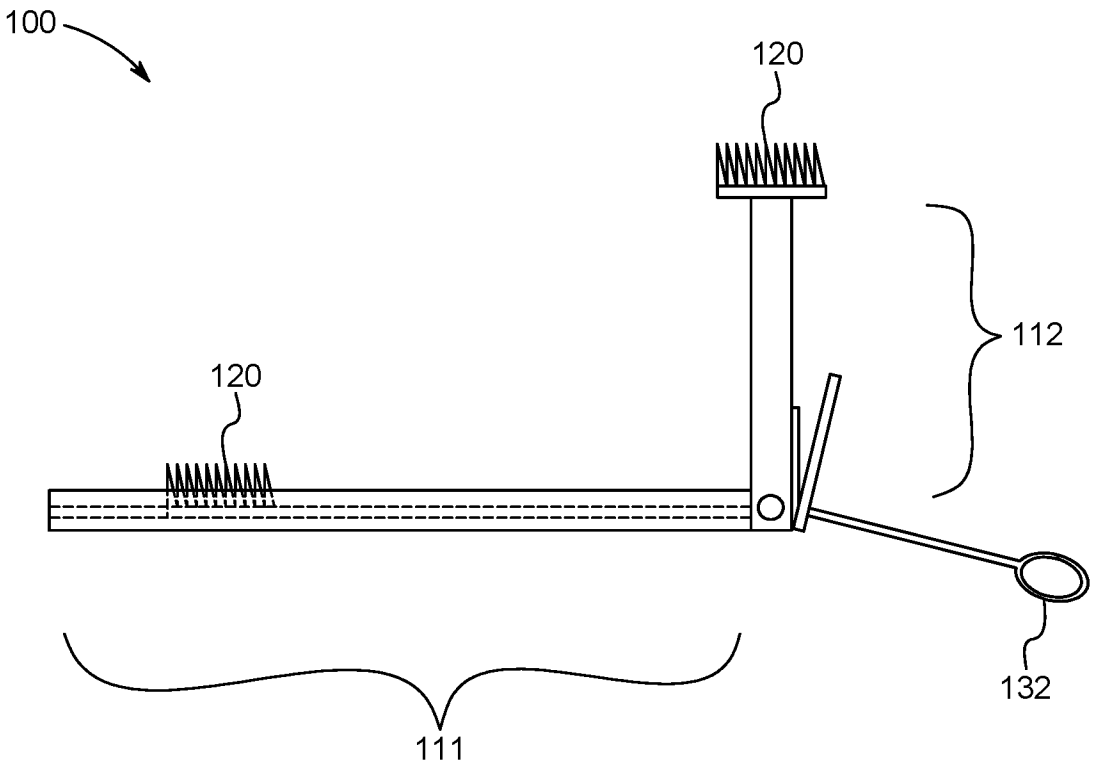
FIG. 2B illustrates a side view of the carpet-stretching apparatus, according to an exemplary embodiment of the present general inventive concept.

FIG. 2B illustrates a side view of the carpet-stretching apparatus 100, according to an exemplary embodiment of the present general inventive concept.

Referring to FIGS. 2A and 2B, the carpet stretching apparatus 100 is in an inverted position with respect to the surface. Moreover, the handle 131 of the stretch bar manipulation assembly 130 may be removed therefrom.

Therefore, the carpet stretching apparatus 100 may prevent the user from injury to a knee and/or a leg of the user. The carpet stretching apparatus 100 may easily stretch the carpet 10 without significant force applied by the user.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A carpet-stretching apparatus, comprising:

a main frame to connect to at least a portion of a carpet as disposed on a surface, the main frame comprising:

a first section, comprising a first side, a second side disposed perpendicularly away from a first end of the first side at a first end of the second side with respect to a first lateral direction, a third side disposed perpendicularly away from a second end of the second side at a first end of the third side with respect to a second lateral direction, such that the third side is substantially parallel to the first side, a stretch bar transversely disposed between at least a portion of the first side and at least a portion of the third side to move at least one carpet spike in response to movement of the stretch bar, and a plurality of stretch-bar-receiving grooves disposed within at least a portion of the first side, and at least a portion of the third side to facilitate movement of the stretch bar therein, and a second section pivotally disposed along at least a portion of a length of the second side to prevent movement of the first section in response to being disposed on the surface;

the at least one carpet spike disposed on at least a portion of the main frame to be inserted into at least a portion of the carpet, such that at least a portion of the carpet moves in response to movement of at least a portion of the main frame; and a stretch bar manipulation assembly disposed on at least a portion of the main frame to move at least a portion of the main frame in response to a manipulation of the stretch bar manipulation assembly.

2. The carpet-stretching apparatus of claim 1, wherein the stretch bar manipulation assembly comprises:

a handle to facilitate gripping thereof; and a release bar to facilitate movement of at least a portion of the main frame in response to movement of the release bar.

3. The carpet-stretching apparatus of claim 1, further comprising:

a support bar disposed within a portion of the stretch bar manipulation assembly to prevent movement of the main frame in response to a force applied thereupon directed toward the surface.

4. The carpet-stretching apparatus of claim 1, further comprising:

a mechanical cylinder disposed within at least a portion of the main frame to move at least a portion of the main frame in response to the manipulation of the stretch bar manipulation assembly.

* * * * *